US007013498B1

(12) United States Patent
Smith et al.

(10) Patent No.: US 7,013,498 B1
(45) Date of Patent: Mar. 21, 2006

(54) DISPENSER

(75) Inventors: Nigel Peter Smith, Wellington (GB); Rebecca Jane Cunliffe, Cullompton (GB)

(73) Assignee: Global Chemicals (UK) Limited, Bampton Devon (GB)

( * ) Notice: Subject to any disclaimer, the term of this patent is extended or adjusted under 35 U.S.C. 154(b) by 165 days.

(21) Appl. No.: 10/030,343

(22) PCT Filed: Jul. 3, 2000

(86) PCT No.: PCT/GB00/02552

§ 371 (c)(1),
(2), (4) Date: Feb. 4, 2002

(87) PCT Pub. No.: WO01/02653

PCT Pub. Date: Jan. 11, 2001

(30) Foreign Application Priority Data

Jul. 2, 1999 (GB) ..... 9915601

(51) Int. Cl.
*E03D 9/02* (2006.01)

(52) U.S. Cl. ..... 4/231

(58) Field of Classification Search ..... 4/223, 4/225.1, 227.1, 231; 239/274, 310, 314
See application file for complete search history.

(56) References Cited

U.S. PATENT DOCUMENTS

| | | | | |
|---|---|---|---|---|
| 6,178,564 | B1 * | 1/2001 | Leonard et al. | 4/223 |
| 6,230,334 | B1 * | 5/2001 | Camp et al. | 4/231 |
| 6,389,610 | B1 * | 5/2002 | Hautmann et al. | 4/231 |

FOREIGN PATENT DOCUMENTS

| | | | |
|---|---|---|---|
| EP | 0538957 | * | 3/1996 |
| EP | 0785315 | * | 7/1997 |
| FR | 2747139 | * | 10/1997 |

OTHER PUBLICATIONS

English-language abstract of FR 2747139.*

* cited by examiner

*Primary Examiner*—Kevin Shaver
*Assistant Examiner*—Anuradha Ramana
(74) *Attorney, Agent, or Firm*—Welsh & Katz, Ltd.

(57) ABSTRACT

The invention provides a dispenser which can be suspended over the rim of a toilet bowl to dispense a dose of active ingredient into the bowl as the bowl is flushed. The dispenser draws active liquid from a reservoir in discrete doses, each does being released by a pumping action which is caused by the action of the flush water on the dispenser. The dispenser includes a flow restrictor which normally prevents egress of the active liquid from the reservoir but which releases a dose under the influence of the pumping action.

10 Claims, 4 Drawing Sheets

DISPENSER

FIELD OF THE INVENTION

This invention relates to a dispenser and, in particular, to a dispenser adapted for suspension from the rim of a toilet bowl to dispense one or more active substances, such as cleansing and/or freshening preparations, into the bowl as the toilet is flushed.

BACKGROUND TO THE INVENTION

Devices suspended from the rims of toilet bowls, to dispense freshening and/or cleaning preparations, are well known. In one form, such a device comprises a cage used to retain a replaceable block impregnated with disinfectant and/or freshening agent. When the toilet is flushed, the flush water passes through the cage and degrades part of the block. The active substances from the block are entrained in the water and thus pass out into the toilet bowl.

More recently rim mounted toilet cleaning and freshening devices have become available which include a porous pad in communication with a reservoir of a viscous liquid cleaning and freshening substance. The liquid substance saturates the pad and is drawn out when flush water is directed over the pad. As active cleaning liquid is flushed from the pad, further liquid is supplied from the reservoir to re-saturate the pad. An example of this type of device is described and claimed in European Patent Application 0 785 315.

Existing liquid dispensing devices of the type disclosed in EP 0 785 315 tend to be quite complex in design so as to prevent excess amounts of active substances emanating from the reservoir, collecting on the already saturated pad, and dripping. Further, with existing products, the source of the active substances is in contact with the pad at all times and, between flushes re-saturates the pad. However, owing to typical viscosities of the active substances, it takes a period of time (typically 15 to 20 minutes) to re-saturate the pad after a flush. Thus, if the toilet is flushed in quick succession, insufficient active substance will have collected on the pad, and thus be released, to provide efficacious results.

It is an object of this invention to provide a simple yet effective form of rim mounted toilet bowl dispenser which dispenses a viscous liquid active substance but which addresses at least some of the drawbacks mentioned above; or which will at least provide a useful choice.

SUMMARY OF THE INVENTION

Accordingly, in a first aspect, the invention provides a dispenser for suspension from the rim of a toilet bowl, said dispenser including:

- a reservoir for containing a viscous liquid active substance;
- a flow restrictor operable to limit the flow of said active substance from said reservoir, said flow restrictor having an inlet side and an outlet side,
- said dispenser being characterised in that application of toilet flushing water thereover creates a pumping action which operates to displace at least one discrete dose of said active substance through said flow restrictor.

Preferably said pumping action provides a pressure differential within said dispenser to drive said active substance through said flow restrictor.

Preferably said pumping action operates to displace a volume of air through said flow restrictor from the outlet side thereof, which volume of air, in turn, displaces said at least dose of active substance through said flow restrictor from the inlet side thereof.

Preferably said dispenser is constructed and arranged so that, in its normal position of use, said active substance contacts the inlet side of said flow restrictor under gravity.

Preferably said dispenser further includes at least one fluid dispensing surface spaced from the outlet side of said flow restrictor from which components of said active substance can emanate. This dispensing surface is preferably positioned to receive active substance from said flow restrictor under gravity.

Preferably said dispensing surface is provided as one or more wall surfaces of a chamber positioned to receive active substance from said flow restrictor. Said chamber is preferably formed, at least in part, from a porous material.

Preferably said chamber includes a substantially vertical peripheral wall and closing means at the bottom of said peripheral wall. Said peripheral wall may be rectangular in cross-section but is preferably cylindrical. Said closing means is preferably formed integrally with said peripheral wall.

All wall sections of said chamber are preferably formed from said porous material. Preferably said closing wall is thicker than said peripheral wall.

Said peripheral wall preferably has a thickness of substantially 2 mm and a porosity of 70 to 125 microns when used with an active preparation of viscosity 400 to 800 cPs.

Alternatively said vertical peripheral wall is non-porous, said dispensing surface being defined by a porous pad or plate positioned in contact with, or closely adjacent, the lower edge of said peripheral wall.

Preferably said dispenser further includes venting means operable to maintain a void on the outlet side of said flow restrictor between flushes.

Preferably said chamber further includes location means operable to fix the alignment of said chamber with respect to said flow restrictor. Preferably said location means and said venting means are defined by a common part of said chamber. This common part may comprise a slot defined in said vertical peripheral wall.

Preferably said dispenser further includes ramp means constructed and arranged to direct water towards said chamber.

In a second aspect the invention provides a dispenser for suspension from the rim of a toilet bowl to dispense active substance into a toilet bowl, said dispenser including:

- a body member;
- a reservoir for active substance included within or mountable on said body member;
- a dispensing surface positioned to receive active substance from said reservoir and, upon flushing, to release said active substance to flush water; and
- release means operable to control the flow of active substance from said reservoir to said dispensing surface,
- said dispenser being characterised in that said release means is operable to dispense at least one discrete dose of said active substance on to said dispensing surface upon flushing of said toilet.

In a third aspect the invention provides a dispenser for suspension from the rim of a toilet bowl to dispense active substance into the bowl, said dispenser including

- a reservoir for active substance;
- a dispensing surface positioned to receive active substances from said reservoir and to release said active substance to flush water when the toilet is flushed; and release means to control the transfer of said active substance from said reservoir to said dispensing surface, said dispenser being characterised in that, in use, a void is maintained between said reservoir and said dispensing surface between flushes.

Preferably said dispensing surface is formed, at least in part, from a porous material. Preferably said porous material is shaped into a cylinder with one end closed.

Preferably said dispenser is as hereinbefore set forth, wherein said cylinder comprises said chamber.

Many variations in the way the invention may be performed will present themselves to those skilled in the art upon reading the following description. The description which follows should not be regarded as limiting but rather, as an illustration only of one mode of performing the invention. Where possible, a description of any element or component should be taken as including any or all equivalents thereof whether or not specifically mentioned. The scope of the invention should be determined solely by the appended claims.

BRIEF DESCRIPTION OF THE DRAWINGS

One form of dispenser embodying the various aspects of the invention will now be described with reference to the accompanying drawings in which:

FIG. 2: shows a view along the line II—II in

DETAILED DESCRIPTION OF WORKING EMBODIMENT

Figure 2:
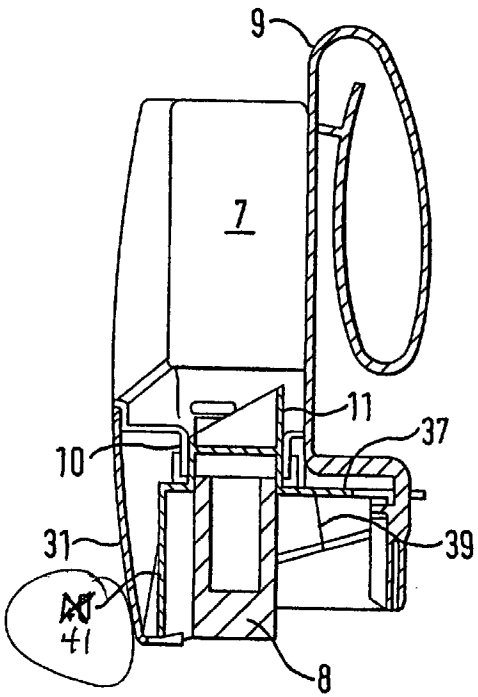

Referring firstly to FIGS. 1 to 6 of the drawings, the present invention provides a dispenser 5 which, in use and as is well known, is suspended over the rim of a toilet bowl (not shown) so as to lie at least partly in the path of flush water when the toilet is flushed. In the conventional manner, part of the flush water passing over the dispenser entrains substances contained therein, and carries these substances down into the toilet bowl. The active substances typically comprise or include disinfectants, odour neutralisers, fragrances etc.

In the form shown, the dispenser comprises four main parts, a moulded body section 6, a detachable active substance reservoir 7, a dispensing surface in the form of chamber 8, and a hook section 9. The hook section 9 is preferably formed integrally with the body section 6, whilst the substance reservoir 7 and the chamber 8 are preferably separate components which are engaged with the body section 6 and integral hook section 9, to render the dispenser operable.

Figure 1:
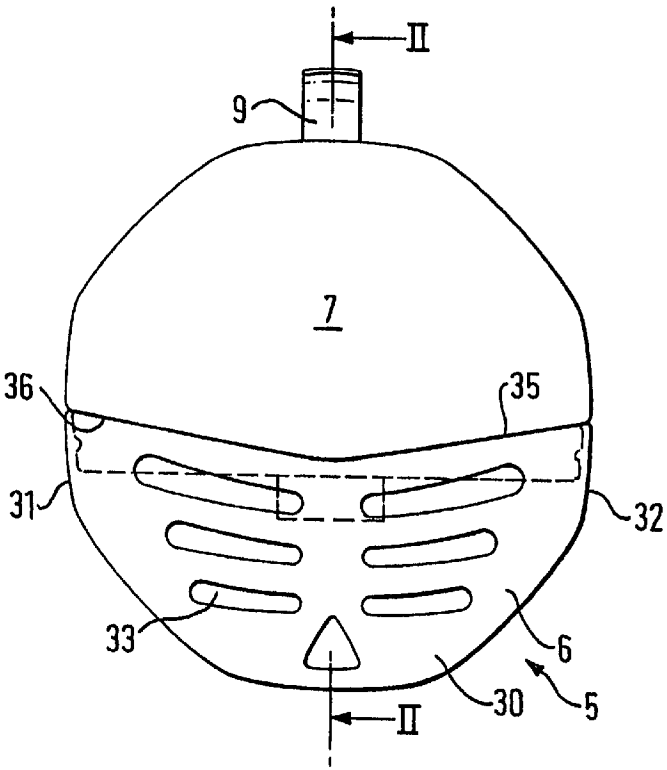
FIG. 1: shows a front elevational view of a dispenser according to the invention.
Figure 4:
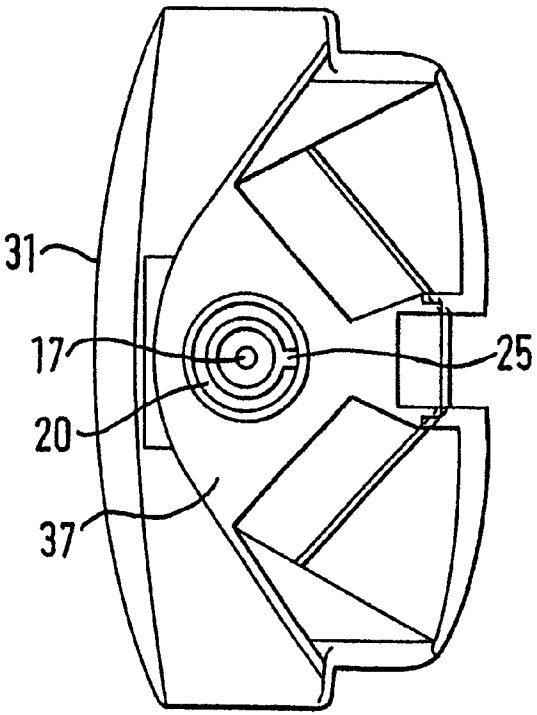
FIG. 4: shows a view, from below, of the dispenser shown in FIGS. 1 to 3, with chamber and suspension hook removed.
Figure 3:
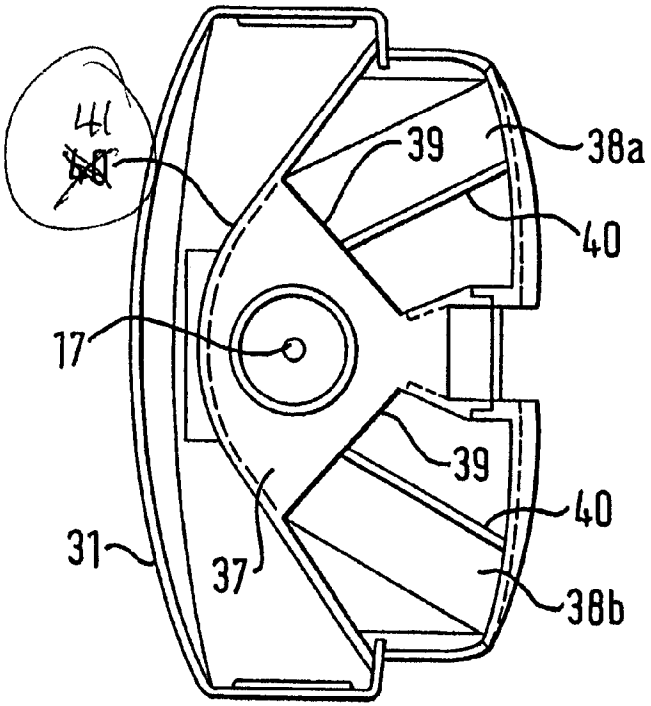
FIG. 3: shows a view, from above, of the dispenser shown in FIGS. 1 and 2 with reservoir and suspension hook removed.

As can be seen in FIGS. 1 and 2, when in use, the reservoir 7 is inverted and engaged, via the outlet neck 10 thereof, over a hollow mounting spigot 1 projecting upwardly from the body section 6. The upper edge of the spigot 11 may, as shown, be formed into a barb 12 which serves to pierce a frangible membrane (not shown) which is provided over the outlet aperture of the reservoir, during manufacture thereof, to prevent leakage prior to use.

The spigot 11 has a central vertical bore 13 therethrough in which is located a flow restrictor 14. In the form shown, the flow restrictor comprises a simple plate having an inlet side 15, an outlet side 16, and a small central hole 17 therein. The hole 17 is sized having regard to the viscosity of the active substance so as to ensure that, when active substance flows from the reservoir 7 under gravity and into contact with the inlet side 15 of the restrictor 14, surface tension prevents flow through the hole 17. However, under the effect of the pumping action generated when the toilet is flushed, at least one dose of the active substance is displaced through the hole 17.

Using an active substance with a viscosity in the range of 450 to 700 cPs, we have found that a round hole 17 of 2 mm diameter provides satisfactory results. Having said that, satisfactory results are also achieved using an active substance of a viscosity as low as 120 cPs, in conjunction with a star shaped aperture having a net diameter of about 2 mm.

Provided on the outlet side 16 of the flow restrictor is a small outlet channel 18.

Also located on the outlet side of the flow restrictor 14 is a fluid dispensing surface on which the unit of active substance dispensed through the flow restrictor can gather for subsequent removal by the toilet flush water, and from which components of the active substance, such as fragrance, can emanate. In the form shown in FIGS. 1 to 6, the dispensing surface is incorporated in the walls of chamber 8 located in recess 20 formed in the body part 6.

As can be seen, the chamber 8 is constructed and positioned to lie in the path of the flush water when the dispenser is suspended from the toilet rim in the known manner. At least part of the wall defining the chamber is formed from a porous material so that a dose of active substance passing through the flow restictor and collecting in the chamber 8 can permeate through parts of the chamber walls and gather on the outer surface of the chamber. When the toilet is next flushed, the flush water entrains the active substance which has collected on the outside of the chamber (and perhaps some which is still within the chamber wall but close to the outer surface) and the same out into the toilet bowl. Between flushes, the dose of active substance entrained in the chamber walls emanates fragrance to freshen the toilet environment.

In the particular embodiment depicted and described in FIGS. 1 to 6, the chamber 8 is oriented substantially vertically and all walls thereof are defined by porous material. It will be noted, however, that the base or closing wall 21 of the chamber is preferably thicker than the vertical wall sections 22. This results in the passage of active substance through the base being less (or slower) than passage through the vertical wall sections.

Figure 6:
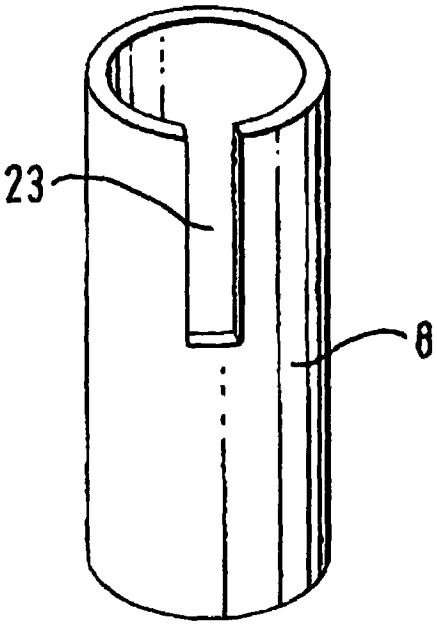
FIG. 6: shows a fluid receiving and emanating chamber for incorporation in the dispenser shown in FIGS. 1 to 5.
Figure 5:
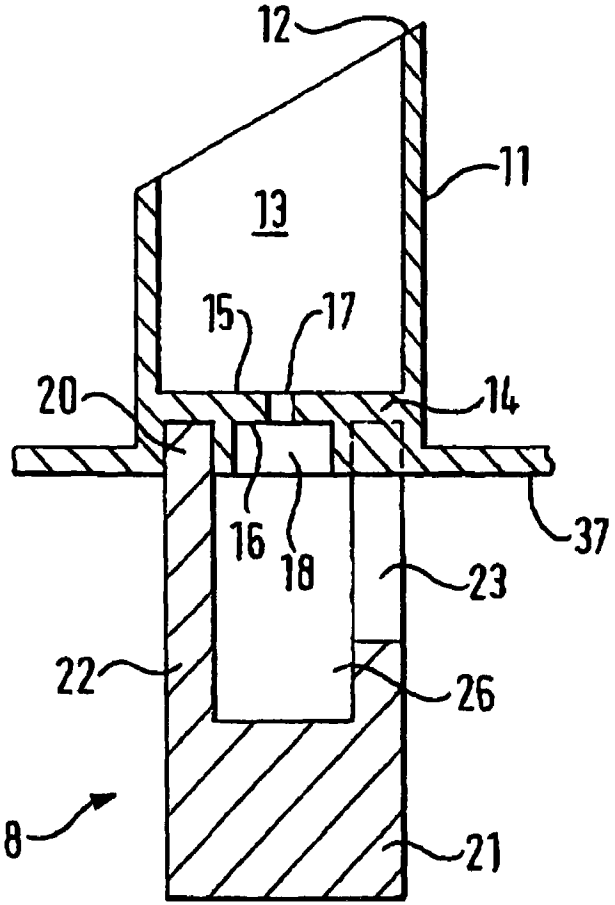
FIG. 5: shows an enlarged view of part of the view shown in FIG. 2.

It will be noted from FIGS. 5 & 6, that the chamber 8 is also provided with a vertical slot 23 extending down from the upper edge thereof, the slot 23 stopping short of the upper surface of the closing wall 21. This, in combination with the thicker section of the closing wall 21, reduces the likelihood of active substance dripping from the chamber 8 between flushes. However, the principal purpose of the slot 23 is to ensure rapid entry of the flush water into chamber 8, and rapid drainage of the same water therefrom. The rapid entry of the water into chamber 8 is believed to generate a pumping action which pushes air through the flow restrictor and into reservoir 7. The air forced into the reservoir, in turn, displaces a dose of active substance back through the flow restrictor 14. It may also be that the surge of flush water simply disturbs the surface tension of the active substance where it covers the flow restrictor 14, thus allowing a unit dose of the active substance to pass through the restrictor.

At the end of the flush, the water drains quickly through the slot 23 and thus maintains a void between the source of active substance and the dispensing surface. This is important to prevent diffusion of water into the active substance which would dilute and lower the viscosity of the active substance, until ultimately rendering the system uncontrollable.

When the chamber 8 is mounted within recess 20 in the body section, the slot 23 is located about key 25 (FIG. 4) which closes across part of the recess 20. This ensures that, when the dispenser is mounted in its operative position beneath the rim of a toilet bowl, the slot 23 is aligned rewardly and in the general direction of the flow of flush water deflected over the dispenser. However, it is conceivable that the chamber 8 may be rotatable within the body section to allow the slot to be positioned to eve a greater or lesser amount of flush water, thereby varying the pumping action and amount of active substance leased per flush.

The precise geometric configuration of the chamber 8 can be varied. In the embodiment shown the vertical walls 22 are defined by a cylindrical wall section, but a rectangular arrangement could also be used. The benefit of the cylindrical section is that the chamber can be readily and efficiently formed by boring a central hole 26 in a rod of porous material. However, the chamber could be formed in a number of alternative ways including cutting lengths of porous rod and plugging one end thereof.

The chamber is preferably formed from sintered polypropylene material manufactured by Sintair Limited of Kings Lynn, Norfolk, England.

The performance of the dispenser as described herein is affected by the size of the chamber 8, area of exposure to the flush water, material porosity from which the chamber is formed, and the viscosity of the active substance. In experimental testing, we have found that satisfactory results are achieved using a chamber having an outside diameter of 12 mm, an inside diameter of 8 mm, a side wall thickness of 2 mm and a base thickness of about 10 mm. When mounted in recess 20, about 20 mm of vertical wall section 22 is exposed below the body section. The chamber as above described is formed in a sintered material having a mean porosity of 120 micron and preferably receives an active substance of ity in the range 120 to 700 cPs.

Obviously one can maintain an effective operating balance by varying the porosity of the chamber wall and also varying the viscosity of the active substance and the diameter of hole 17.

The body section 6 includes a front face 30 and end walls 31 and 32 which from an outer cage about the mounting spigot 11 and the chamber 8. The front face 30 includes apertures 33 therein to enhance the aesthetic appearance of the dispenser and to allow flush water to pass out through the front surface of the dispenser. As can be seen in FIG. 1, the top edge 35 of the front face 30 is shaped to correspond to the form of the upper edge 36 of reservoir 7 so that the reservoir is neatly located and retained by body 6 when inverted and mounted on the body section 6.

The spigot 11 projects substantially vertically from a horizontal central web section 37 which extends rewardly of the front face 30 and effectively spaces the front face 30, and side walls 31 and 32, forward of the mounting point on a toilet bowl. To the rear, and below, the web 37 are located a pair of downwardly directed ramp surfaces 38*a* and 38*b* which terminate in vertical apertures 39 facing the chamber 8. The ramp surfaces 38*a*, 38*b* serve to deflect flush water in the direction of the chamber 8 and may be provided with vanes 40 to further capture and align the flush water.

It will be further noted that the body section includes an intermediate wall section 41 which extends behind the body front surface 30 but in front of the chamber 8. This wall section 41 serves to ensure the chamber 8 is only contacted by active substance and flush water and, in particular, cannot be "targeted" by males urinating in the toilet bowl.

Finally it will be noted that the suspension hook 9 extends from a rearward extension of the central web section 37.

In use, the dispenser 5 is mounted beneath the rim of a toilet bowl, by suspension hook 9, so that the front ace 30 is directed towards the interior of the bowl. When the toilet is flushed, a proportion of the toilet flush water circulating around the underside of the rim is defected toward ramp surfaces 38*a* and 38*b* and, thereafter, through apertures 39 and into contact with chamber 8. Since the slot 23 in the chamber 8 is awed substantially with the flush water steam, some flush water will pass directly into the chamber causing a pumping action which causes a discrete dose of active substance to pass through hole 17 in the flow restrictor 15, and down into the chamber 8. The dose of active permeates through the chamber walls and releases fragrance and other vapour components. At the next flush, the dose is removed by the flush water to pass into the toilet bowl and is replaced by another discrete dose.

Figure 8:
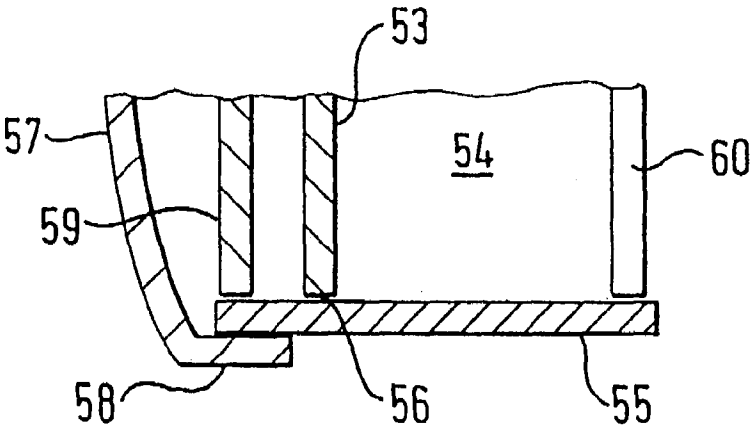
FIG. 8: shows an enlarged view of the area ringed in FIG. 7.
Figure 7:
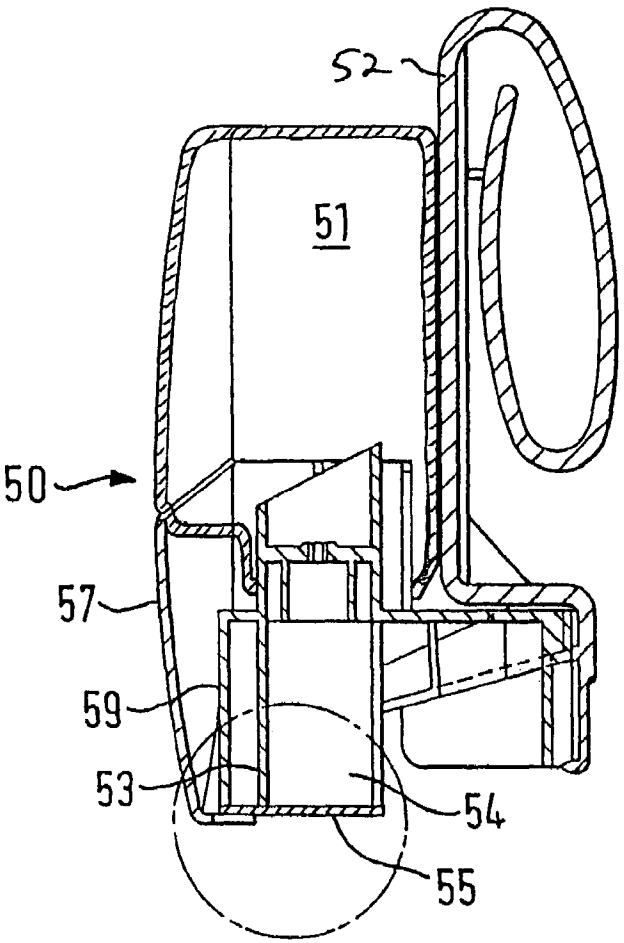
FIG. 7 shows a similar view to FIG. 2 but of an alternative embodiment of dispenser according to the invention.

Turning now to FIGS. 7 and 8, a dispense r 50 is shown for dispensing discrete doses of active substance from reservoir 51. As with the embodiment described above, the dispenser includes a hook section 52 which is configured, and operates identically, to the hook section 9 of that embodiment.

Indeed the dispenser 50 is in most respects identical to the dispenser 5. The only important difference is that the porous chamber 8 is replaced by a non-porous peripheral wall section 53, defining chamber 54, which operates in conjunction with a porous pad 55, the pad 55 being in contact with, or positioned closely adjacent to, the lower edge 56 of the wall section 53.

In the form shown, the front face 57 of the dispenser is formed into a rearwardly aligned ledge 58 at the lower end thereof. The ledge 58, in combination with the lower edge 56 of the wall section 53, and the lower edge of intermediate wall section 59, defines a clipping slot which retains the pad 55 in position.

As with the porous chamber 8, the peripheral wall section 53 includes a rearwardly aligned, vertically extending slot 60 which, as shown, extends the full height of the wall section 53. This allows flush water to enter the chamber 54 and create the pumping action in the manner described above.

The use and operation of the dispenser 50 is identical to that of dispenser 5 described above. The advantage of the dispenser 50, over dispenser 5, is that the pad 55 generally provides a greater surface area than porous chamber 8, from which fragrances can emanate, between flushes.

Whilst the predominant pumping action is believed to be a positive displacement of air within chamber 8, 54 and channel 18 into the reservoir 7, 51 causing active substance to be displaced back through the hole 17, the rapid passage of flush water over the outlet channel 18, as well as the rapid drainage of flush water through slot 23, 60 may, in addition, create venturi effect of suction which draws active through the hole 17. Obviously the configuration of the dispenser herein described could be varied to enhance the venturi or suction effect.

It is also possible to provide an air bleed tube up through the reservoir to vent the headspace within the reservoir, to the void beneath the flow rector 14.

Whatever the precise dose release action way be, we have found that a dispenser as above described displays the following attributes:

1) Efficacious rest are achieved with each flush, no matter how close together the Rushes in contrast to prior art dispensers which take considerable time to recover to
2) The toilet and surrounding areas are freshened continuously;
3) One or more discrete doses of active are released each flush ensuring constant performance over the life of the contents of the reservoir.

It will thus be appreciated that the present invention provides a simple yet effective form of rim mounted dispenser for dispensing active substances into a toilet bowl.

What is claimed is:

1. A dispenser for suspension from the rim of a toilet bowl to dispense viscous liquid active substance into a stream of water created when the toilet is flushed, said dispenser including:

a reservoir containing said viscous active substance within an interior thereof, a body section supporting said reservoir and for releasing a dose of said viscous active substance from said reservoir, under gravity, when the toilet is flushed;

a flow restrictor having an inlet side in communication with the interior of said reservoir an outlet side, and at least one aperture extending between said inlet side and said outlet side, said aperture being sized to, in combination with the viscosity of said active substance, restrain said active substance by surface tension from flowing under gravity from said reservoir;

an outlet channel extending from said outlet side and being in direct communication with said at least one aperture; and ramp surfaces on said body section to direct said stream of water toward said outlet channel, wherein in use, said stream of water is directed into said outlet channel and into contact with said outlet side of said flow restrictor, overcomes said surface tension and effects the release of a dose of said viscous active substance from said reservoir.

2. A dispenser as claimed in claim 1 further including at least one fluid dispensing surface spaced from the outlet side of said flow restrictor from which components of said active substance can emanate.

3. A dispenser as claimed in claim 2 wherein said dispensing surface is positioned to receive active substance from said flow restrictor under gravity.

4. A dispenser as claimed in claim 2 wherein said dispensing surface is provided as one or more wall surfaces of a chamber positioned to receive active substance from said flow restrictor.

5. A dispenser as claimed in claim 4 further including ramp means constructed and arranged to direct water towards said outlet side.

6. A dispenser as claimed in claim 4 wherein said chamber is formed, at least in part, from a porous material.

7. A dispenser as claimed in claim 4 wherein said chamber includes a substantially vertical peripheral wall.

8. A dispenser as claimed in claim 7 wherein said peripheral wall is cylindrical.

9. A dispenser as claimed in claim 1 wherein an outlet side of said flow restrictor is defined by a non-porous peripheral wall section in combination with a porous bottom surface.

10. A dispenser as claimed in claim 1 further including venting means operable to maintain a void on the outlet side of said flow restrictor between flushes.

* * * * *